US006805971B2

(12) United States Patent
Talia et al.

(10) Patent No.: US 6,805,971 B2
(45) Date of Patent: Oct. 19, 2004

(54) METHOD OF MAKING COATINGS COMPRISING AN INTERMETALLIC COMPOUND AND COATINGS MADE THEREWITH

(76) Inventors: George E. Talia, 8807 E. Harry St., Apt. 801, Wichita, KS (US) 67207; Fred J. Callahan, 1008 Sherwood Cir., Salisbury, MD (US) 21804

( * ) Notice: Subject to any disclaimer, the term of this patent is extended or adjusted under 35 U.S.C. 154(b) by 0 days.

(21) Appl. No.: 10/137,557

(22) Filed: May 2, 2002

(65) Prior Publication Data

US 2003/0206819 A1 Nov. 6, 2003

(51) Int. Cl.[7] ..... B22F 7/04

(52) U.S. Cl. ..... 428/553; 419/8; 419/9; 419/45

(58) Field of Search ..... 428/553; 419/8, 419/9, 45, 32

(56) References Cited

U.S. PATENT DOCUMENTS

| | | | | | |
|---|---|---|---|---|---|
| 3,978,251 | A | | 8/1976 | Stetson et al. | 427/229 |
| 4,121,928 | A | | 10/1978 | Mori | 75/208 |
| 4,180,622 | A | | 12/1979 | Burkhard et al. | 428/564 |
| 4,290,510 | A | | 9/1981 | Warren | 188/218 |
| 4,535,035 | A | | 8/1985 | Smialek | 428/698 |
| 4,595,545 | A | | 6/1986 | Sane | 264/65 |
| 4,596,841 | A | | 6/1986 | Konishi et al. | 523/410 |
| 4,623,388 | A | * | 11/1986 | Jatkar et al. | 75/232 |
| 4,668,470 | A | * | 5/1987 | Gilman et al. | 419/32 |
| 4,737,340 | A | * | 4/1988 | Dolgin | 420/129 |
| 4,762,558 | A | | 8/1988 | German et al. | 75/246 |
| 4,795,660 | A | | 1/1989 | Cooray et al. | 427/123 |
| 4,830,819 | A | | 5/1989 | Sakuramoto et al. | 419/8 |
| 4,834,942 | A | | 5/1989 | Frazier et al. | 420/552 |
| 4,946,500 | A | | 8/1990 | Zedalis et al. | 75/232 |
| 5,100,486 | A | | 3/1992 | Krikorian et al. | 148/248 |
| 5,156,912 | A | | 10/1992 | Lukco et al. | 428/367 |
| 5,273,782 | A | | 12/1993 | Sagawa et al. | 427/242 |
| 5,318,217 | A | | 6/1994 | Stinson et al. | 228/194 |
| 5,350,107 | A | | 9/1994 | Wright et al. | 228/198 |
| 5,362,523 | A | | 11/1994 | Gorynin et al. | 427/446 |
| 5,562,999 | A | | 10/1996 | Grunke et al. | 428/651 |
| 5,705,280 | A | | 1/1998 | Doty | 428/539.5 |
| 5,736,198 | A | | 4/1998 | Yasutomi et al. | 427/419.7 |
| 5,788,142 | A | | 8/1998 | Bigay et al. | 228/198 |
| 5,807,613 | A | | 9/1998 | Aguero et al. | 427/528 |
| 5,820,940 | A | | 10/1998 | Gorynin et al. | 427/455 |
| 5,855,955 | A | | 1/1999 | Claar et al. | 427/248.1 |
| 5,864,744 | A | | 1/1999 | Bigay | 419/29 |
| 5,958,522 | A | | 9/1999 | Nakagawa et al. | 427/456 |
| 6,030,472 | A | | 2/2000 | Hajaligol et al. | 148/651 |

* cited by examiner

*Primary Examiner*—Daniel Jenkins
(74) *Attorney, Agent, or Firm*—Simpson & Simpson, PLLC

(57) ABSTRACT

A method for forming a metallic coating on a substrate comprising an intermetallic compound, and the coatings made by this method are disclosed. The method broadly comprises forming an alloyed agglomerate from a precursor comprising at least two metals suitable for forming an intermetallic compound and depositing a coating of the partially converted agglomerate onto a roughened surface of a substrate.

48 Claims, No Drawings

METHOD OF MAKING COATINGS COMPRISING AN INTERMETALLIC COMPOUND AND COATINGS MADE THEREWITH

FIELD OF THE INVENTION

The present invention relates generally to high-performance, self-adjusting, protective coatings and methods of manufacture. These coatings are capable of conforming to the geometrical and mechanical configurations of substrates to which they are applied. Accordingly, the invention also relates to metallic, ceramic, and polymeric substrates having novel friction, wear, and corrosion resistant metallic coatings firmly bonded thereto. The coatings, which have low porosity, and therefore, are smooth and substantially continuous with minimal defects, are characterized by enhanced wear and heat resistant properties, have a broad range of useful applications, e.g., in motor vehicle components, machinery, and so on.

BACKGROUND OF THE INVENTION

Most brakes are of a frictional type in which a fixed surface is brought into contact with a moving part that is to be slowed or stopped. The limitations on the applications of brakes are similar to those of clutches except that the service conditions are more severe because the entire energy is absorbed by slippage which is converted to heat that must be dissipated. One important aspect is the rate at which energy is absorbed and heat dissipated. With frictional brakes, if the temperature of the brake becomes too high, the result is a lowering of the friction force, called fading. Modem brake rotors/drums and clutches, for example, require specific properties to be able to withstand in some instances, extreme operating conditions often associated with high performance motor vehicles, including racing cars.

Intermetallic compounds are known in the art to provide some of these desired properties. Intermetallic compounds are generated by chemical reactions between two or more metals. In general they have ceramic-like properties, such as high strength (especially at high temperatures) and excellent erosive and corrosive resistance. They have some properties superior to ceramics, such as better adhesion and ductility. However, after their application onto a substrate, intermetallic compounds are difficult to form or polish due to their brittle nature at room temperature. In contrast, chrome and nickel are easy to form or polish, but they corrode, erode, and oxidize easily.

One type of intermetallic coating is disclosed by U.S. Pat. No. 5,820,940 (Gorynin et al). This patent teaches an adhesive coating prepared from thermally reactive binary and multicomponent powders. It is a diffusion type intermetallic coating wherein thermally reactive metal powders containing aluminum are introduced into a plasma torch. An exothermic reaction within the thermally reactive powders is initiated in the plasma torch, which is completed after impingement of the exotherm onto the substrate. According to the United States Patent, the heat generated by the exothermic reaction promotes diffusion of the intermetallic compound into the substrate for improved bonding.

While the methods of Gorynin et al. allow for excess unreacted aluminum remaining dispersed throughout the layer for imparting ductility and flexibility, means for controlling final surface properties and minimizing surface defects, such as high porosity, lack of smoothness, or for preventing cracks from developing during the cool down stage, are neither taught nor suggested. Surface characteristics, including shape, surface smoothness/roughness, porosity and crack development, and other microstructural defects are not readily prevented by mechanically working (shaping or polishing) after such coatings are substantially fully reacted.

Accordingly, there is a longfelt need for a economical method to form an intermetallic coating on a substrate that allows working of the material to form it into the desired shape for removal of flaws.

SUMMARY OF THE INVENTION

The present invention broadly comprises a method for forming a metallic coating on a substrate comprising an intermetallic compound, and the coatings made by this method. The method broadly comprises forming an alloyed agglomerate from a precursor comprising at least two metals suitable for forming an intermetallic compound and depositing a coating of the partially converted agglomerate onto a roughened surface of a substrate.

A general object of the present invention is to provide a method for forming a metallic coating on a substrate comprising an intermetallic compound.

It is another object of the present invention to provide an economical method for forming a coating by a method that allows the working of the material into the desired shape, and the removal of flaws.

It is yet another object of the present invention to provide an economical method for forming particulates comprising an intermetallic compound.

It is yet another object of the present invention to provide an economical method for bonding together two surfaces using a metallic layer comprising an intermetallic compound.

This and other objects, features and advantages of the present invention will become readily apparent to those having ordinary skill in the art upon a reading of the following detailed description of the invention in view of the claims.

DETAILED DESCRIPTION OF THE PREFERRED EMBODIMENT

As a principal object, the invention provides for novel metallic coatings comprising an intermetallic compound for application principally to metal and ceramic substrates. In addition, the coatings may be applied to various polymeric substrates. They may include, for example, thermoplastic and thermosetting resins, such as polyesters and the so-called amino resins, to name but a few groups. In sum, the invention relies on coating various types of substrates ranging from high temperature, wear resistant structural materials to the fabrication of motor vehicle components and parts for systems, including surfaces for brake/clutch parts and other friction bearing surfaces, like clutch plates, surface coatings for pistons, coatings for cylinder bores of engines, and so on. The coatings are made by a unique sequence of processing steps to impart properties to enable their use in a broad range of applications.

The coatings are made according to the following method. As a preliminary step, the surface of the substrate to be coated is roughened by known methods, such as by graining, sand blasting, or any other convenient means known in the art. Next, elemental metal particulates, powders, platelets, or wires are blended together to form a precursor. Any blending method known in the art may be used. In a preferred embodiment, rapid solidification spray is used as it produces a homogenous powder blend. This precursor is suitable for being formed into an intermetallic compound. The metals typically used are aluminum, nickel, titanium, iron, or any combination of these metals. Other representative metals include boron, chromium, tungsten, and molybdenum, to name but a few. Preferred combinations of metals are those that will form aluminides, i.e., nickel aluminide, titanium aluminide, iron aluminide, etc. Also in a preferred embodiment, an intermetallic compound with a similar thermal expansion coefficient as the substrate is chosen, to minimize residual stresses. If the chosen intermetallic compound has a thermal expansion coefficient that is very different from the substrate, then the final coating should include a smaller percentage of intermetallic compound. Proportional ranges of metal powders for preparation of aluminides are generally from about 10 to about 50 percent-by-weight aluminum powder, and from about 50 percent to about 90 percent of the secondary metal, i.e. nickel, titanium, iron, etc. Additional other powdered metals may be used in lesser amounts ranging from about trace amounts to about 15 percent-by-weight. In addition, the morphology of the coating may also be modified with types of particulates, such as, whiskers, carbides (SiC), alumina fibers, and other metallic and ceramic particulates, etc., in amounts readily determined by persons skilled in the art. The friction coefficient, specific strength, and specific modulus of the coating can be further enhanced by reinforcing them with friction and wear enhancers, i.e., boron, carbon, or silicon carbide filaments/particles. However, any combination of the aforementioned substances suitable for forming an intermetallic compound can be used, and these combinations are within the spirit and scope of the invention as claimed. The following table provides some preferred ranges of metal powders for the generation of coatings of the invention:

TYPICAL PRECURSOR MIXES

| Intermetallic coating materials | Aluminum Weight % Range | Iron Weight % Range | Nickel Weight % Range | Titanium Weight % Range | Sulfur Weight % Range | Cadmium Weight % Range | Additional Elements % Range |
|---|---|---|---|---|---|---|---|
| CdS | N/A | N/A | N/A | N/A | 22 ± 0.01 | 78 ± 0.01 | Traces |
| $Ti_3Al$ | 16 to 18 | N/A | N/A | 82 to 84 | N/A | N/A | Traces |
| TiAl | 35 to 45 | N/A | N/A | 55 to 65 | N/A | N/A | Traces |
| TiAl—B | 35 to 45 | N/A | N/A | 55 to 65 | N/A | N/A | 0.2 to 0.4 B |
| $Ni_3Al$ | 13 to 17 | N/A | 84 to 87 | N/A | N/A | N/A | Traces |
| NiAl | 24 to 36 | N/A | 64 to 76 | N/A | N/A | N/A | Traces |
| NiAl—CdS | 12 to 18 | N/A | 32 to 38 | N/A | 11 ± 0.01 | 39 ± 0.01 | Traces |
| NiAl—Cr | 24 to 36 | N/A | 64 to 76 | N/A | N/A | N/A | 0.4 to 1 Cr |
| $Fe_3Al$ | 13 to 20 | 80 to 87 | N/A | N/A | N/A | N/A | Traces |
| FeAl | 33 to 47 | 53 to 67 | N/A | N/A | N/A | N/A | Traces |
| FeAl—CdS | 16.5 to 23.5 | 26.5 to 33.5 | N/A | N/A | 11 ± 0.01 | 39 ± 0.01 | Traces |
| FeAl—Cr | 33 to 47 | 53 to 67 | N/A | N/A | N/A | N/A | 0.4 to 1 Cr |
| $Al_{50}Ni_{30}Fe_{10}Ti_7$ W | 29.5 ± 0.01 | 12.2 ± 0.01 | 38.8 ± 0.01 | 7.5 ± 0.01 | N/A | N/A | 12 ± 0.01 W |
| $Al_{50}Ni_{18}Fe_{30}$—Mo | 31.5 ± 0.01 | 39.2 ± 0.01 | 24.8 ± 0.01 | N/A | N/A | N/A | 4.5 ± 0.01 Mo |

The next step comprises mechanically alloying the precursor to form agglomerates of a precursor intermetallic materials mix (PIMM). This typically comprises tumbling the precursor materials in a rotating cylinder or a V-cone blender. Any method known in the art for mechanical alloying may be used, and these modifications are within the spirit and scope of the invention as claimed. The mechanical alloying causes some of the precursor to form an intermetallic compound. The level of the conversion of the precursor to an intermetallic compound depends on the extent of the mechanical alloying. The more the precursor is converted to an intermetallic compound, the tougher the precursor is, making it harder to work. Further, the blending and the mechanical alloying may be done in one step, and this modification is within the spirit and scope of the invention as claimed.

As an alternative to mechanical alloying, part of the blend may be vacuum reacted, which degasses the material and converts some of it to an intermetallic compound. The degassing drives off moisture and reduces amorphous oxides to crystalline oxides in the case of a matrix of aluminum, magnesium, or titanium.

In a preferred embodiment, the precursor blend is alloyed or vacuum reacted as described above. However, coatings may be made by a process that omits alloying or vacuum reacting, as long as the final step is reactive sintering. These modifications are intended to be within the spirit and scope of the invention as claimed.

At this point, the PIMM may be reactively sintered to form intermetallic particulates. The reactive sintering temperature for the film will be within the recommended temperature range for sintering the precursor mix in a solid or quasi-solid/liquid state. In a preferred embodiment, a high temperature fluidizing bed is used to avoid agglomeration of the particles. However, simple tumbling and reaction milling can be used. It should be readily apparent to one skilled in the art that this process can be used to form intermetallic powders, filaments, platelets, fibers, or any other shape or form. Any intermetallic particles made by this process are within the spirit and scope of the invention as claimed. These intermetallic compounds can then be used as additives in other manufacturing processes.

If a coating is desired, the PIMM is then thermally treated to further react part of the mix constituents into an intermetallic compound. The PIMM is then deposited on the roughened surface of the substrate using methods known in the art. If a thermal deposition process is used, such as flame or plasma spray deposition, hot mechanical pressing, or any other thermal deposition method known in the art, then the constituents of the PIMM will further form an intermetallic compound. Thus, the thermal treatment may be omitted if a thermal deposition method is used. Thermal deposition methods should not exceed the temperature of the final reactive sintering. Cold deposition methods may also be used, such as cold pressing, smearing, chemical deposition, cladding, pressing, stamping, drawing, or any other cold deposition process known in the art. (However, some cold deposition methods may require the substrate to be a pre-fixed form or a molded product.) These modifications are within the spirit and scope of the invention as claimed. The deposition forms a thin, soft, malleable, metallic film containing both intermetallic particles and particles of the original components.

In a preferred embodiment, the PIMM is thermally treated as described above. However, coatings may be made omitting this step, and these modifications are intended to be within the spirit and scope of the invention as claimed.

Thermal spray coatings are produced from either wire or powder materials that can be melted into droplets, and then propelled onto the selected substrate. Upon impact, they form platelets that adhere to the surface, creating a rather dense and protective coating with no alteration to the substrate structure.

Plasma spraying can be performed using heat transfer from a high-KW electric arc to a plasma-forming gas directed through flow enhancing nozzles. Within the spray device the gas flow chamber contains an axial stick cathode adjacent to the nozzle that forms a ring anode. In the controlled gap a DC arc is maintained through which the exiting gas must pass. Heated to nominal temperatures, part of the gas ionizes to plasma. Metallic powder is injected into the exit plume, which may melt or elasticize the powder in the gas and propel it at high velocity to the part surface. Dilution of the plume and refined cooling techniques keep surface temperature low avoiding undesirable premature initiation of the exotherm.

Flame spraying can be performed by burning a mixture of oxygen and acetylene in a torch having a flame-accelerating nozzle. For materials in wire form, the flame is concentric to the wire fed through the nozzle axis. Combustion gas melts, atomizes, and propels molten particles to the surface for coating. Particles are injected into the flame nozzle by carrier gas, where they are projected to the substrate surface.

In the preferred embodiment, the film is then plastically deformed by mechanically conditioning the film, for instance, by rolling, pressing, machining, peening, and/or polishing the coated surface to obtain the desired shape and/or surface conditions. The film can be plastically deformed (cold worked), or plastically deformed in the presence of heat, below the sintering temperature, at a reduction ratio high enough to achieve intimate contact between dissimilar metallic surfaces, for example. When the film is thus deformed, the metal particles bond to form a continuous matrix. Mechanically working the film limits porosity and increases the strength and cohesion of the final coating to the substrate. Pressing and rolling are preferred choices of plastic deformation. The PIMM films are able to fill voids and imperfections, and self-adjust to configurations established by surface restraints. The mechanical working further converts some of the film into an intermetallic compound.

In addition, by mechanically working deposited films in their soft malleable state before conversion of a portion of the film to a hardened intermetallic state, such as by compression or polishing before sintering or before completion of the sintering process, the soft films flow into and fill surface pores and defects in the work piece. When the surface is subsequently reactively sintered to convert the precursor metals into a metallic coating comprising an intermetallic compound, very strong, durable bonds are formed between the hard ceramic-like coating and the roughened work piece. Accordingly, the methods of this invention are also useful for their ability to repair damaged, or otherwise imperfect surfaces on substrates, including metallic, ceramic, and polymeric types.

In a preferred embodiment, the deposited film is mechanically worked as described above. However, coatings may be made omitting this step, and these modifications are intended to be within the spirit and scope of the invention as claimed.

The conditioned film is then reactively sintered to convert the film into a metallic coating comprising an intermetallic compound. The reactive sintering temperature for the film will be within the recommended temperature range for sintering the precursor mix in a solid or quasi-solid/liquid state. In general, the reaction temperature is near the melting point of the metal of the precursor mix having the lowest melting point. For example, nickel-aluminum metal coatings and titanium-aluminum coatings are preferably reactively sintered at about 650° C., somewhat below the melting point of aluminum metal. In this instance, the coating is reactively sintered in a solid state. Partially and fully reacted materials with multiple phases are obtained. Phase formation correlates well with increasing hardness values. The reaction in the initial mix is limited by the natural oxide layers of the metal particles. Mechanical deformation enhances the reaction by breaking down the natural oxides on the powders. This heating may be done by any surface or bulk heating method known in the art, such as friction, laser, flame, plasma, or furnace. In a preferred embodiment surface heating is used. However, any heating method known in the art is within the spirit and scope of the invention as claimed.

In a preferred embodiment, the mechanically worked film is reactively sintered as described above. However, coatings may be made omitting this step, as long as the film was thermally applied to the substrate. These modifications are intended to be within the spirit and scope of the invention as claimed.

The expression "reactive sintering," as used in the present specification and claims, is intended to mean a process wherein heat is applied to a composition, causing that composition to undergo, at least in part, a chemical reaction forming a new composition. The composition is heated to below or about its melting point, in contrast to the art recognized term "sintering." "Sintering" is known in the art as a heating process wherein the composition is kept strictly below the melting point.

Other important benefits are realized by mechanically working the films before reactive sintering. The sintering process is normally an exothermic reaction which, in general, has the tendency to form rough or uneven surfaces with defects, e.g., porous, cracked surfaces, and other flaws which can alter the integrity of coatings, including bonds anchoring the coating to the substrate. One cause for defects in coatings heretofore has been due to the release of gases when sintering at high temperatures sufficient to liquefy the deposited metals. Mechanically working the film also increases the level of intermetallics in the film. This decreases the temperature needed to finally reactively sinter the film to form the coating. By reactively sintering the film at lower than usual sintering temperatures, i.e., liquid state, processing time required for completion of the reaction can be shortened. Residual stresses due to the thermal processing are reduced when the thermal processing is carried out at a lower temperature. Reactive sintering in-situ reduces the generation of gases, and concomitantly, the density of the defects in the coating. Advantageously, production processes are also shortened, leading to lower manufacturing costs and improved overall economics. Thus, the thermal treatment of the PIMM and mechanical working of the film both contribute to the reduction of defects in the final coating, as well as reducing the cost of the production of the coating.

In addition to affecting the final sintering temperature, the level of intermetallics in the film contributes to the hardness of the film, and the hardness of the final coating. Thus the composition of the precursor, the extent of mechanical alloying, thermal treatment, and mechanical working, as well as the final reactive sintering temperature and sinter time all contribute to the final hardness and toughness of the coating. A higher percentage of the coating is an intermetallic compound when a tougher coating is desired. In a preferred embodiment, 0 to 70% of the coating by volume is an intermetallic compound. If the percentage of intermetallic compound is greater than about 70%, the intermetallic compound interferes with the consolidation of the coating.

Coatings made by this method can also be used to bond together two objects. A PIMM made by the above description, such as a CdS powder agglomerate, is deposited to form a film on the first object to be joined by mechanical pressing, thermal deposition, fluidizing bed, or powder painting coating methods. The second object to be joined is mechanically joined to the first object, and then in-situ thermally reacted to convert the film into a coating. Powder co-deposition and/or layered deposition methods in conjunction with partial reactions are also used on iron based substrates.

Representative substrates selected for rotors, drums, discs, clutches, for example, are most commercially available high temperature alloys, such as, titanium alloys (Grade 2 and Ti-6Al-4V), superalloys (214 and 230 nickel-base, HR-120 nickel-iron-base, and 556 iron-base), and high temperature steels (15-15 PH). Titanium alloys are widely used as structural materials in the aerospace and chemical industries because of their lower density combined with high strength and corrosion resistance. Superalloys are being used on the most demanding applications of materials. They are subjected to high temperature oxidation, hot corrosion, creep, high-cycle fatigue, and thermal fatigue. Steels are the most commonly employed materials for high performance applications. However, the chemical behavior of the alloys normally limits their application to low to moderately elevated temperatures. Environmental durability is still a concern, especially for titanium alloys and steels at temperatures above 750° to 800° C. This also led to the development of the coatings of this invention for the protection of high temperature alloy brake/clutch parts. High temperature alloy substrates with a coating fabricated by the above-described method provide high performance brakes and clutches to fulfill virtually any modern application, such as racing vehicles, military, aeronautical, commercial vehicles or any other application requiring extreme operating conditions.

The following specific examples are provided to demonstrate the invention, however, it is to be understood they are for illustrative purposes only, and do not purport to be wholly definitive as to conditions and scope of the invention.

EXAMPLE I

Aluminum and nickel powders were prepared by mechanical alloying and blending the powders in the proportions indicated, in a rotating cylinder blender. Powders were vacuum-degassed at 450° C. Then, they were heat treated in a turbulent helium atmosphere at 650° C. (which is less than the melting temperature of aluminum). The finished powders were completely reacted and exhibited an intermetallic structure with very little porosity. The intermetallic particles were thin and elongated throughout the mechanical alloying. The quantitative microstructural analysis of the size distribution and volume fraction of the intermetallic phase was as predicted by the phase diagrams. The average size-breadth of the intermetallic ranged from 4.1 to 5.7 microns. The average length ranged from 9.4 to 16.6 microns. The produced intermetallic powders/particulates were mechanically embedded (rolling) on a clad sheet of aluminum alloy 2024. Subsequent erosion tests of the aluminum sheet demonstrated outstanding properties.

EXAMPLE II

Aluminum powders mixed with nickel, iron, and titanium powders were mechanically alloyed and plasma deposited to produce PIMM films, which is the basis for the formation of intermetallic compounds called aluminides. The plasma deposited films were soft, malleable, and easy to mechanically form or polish. The hardness of the coating depended on the volume fraction of the intermetallic compound, which is a function of the amount of mechanical alloying. The properties of the resulting coating were not influenced by the amount of mechanical alloying or heat treatment done during film deposition. After shaping and polishing the films, the films were heated by friction, plasma, and flame, forming the final coatings. In addition, successful coating production was accomplished using other deposition methods, such as smearing, powder compaction, chemical, and cladding techniques. Composition changes in the PIMM result in coatings with different properties, such as ductility, hardness, and corrosive, erosive, and wear resistance. Finally, coatings were made with PIMMs incorporating additives such as SiC, alumina fibers, and other particles. These additives further changed the properties of the final coatings, such as the lubricity, strength, toughness, and finish morphology. Coating thicknesses of 100 nanometers to 1 millimeter were generated using these processes.

EXAMPLE III

Composition changes in the precursor-material-mix films yield coatings with different properties (i.e., ductility, hardness, corrosive and erosive/wear properties) was demonstrated by the following: On a grained steel brake rotor (15-15 PH) a stoichiometric PIMM of Al—Ni metal without friction enhancers was plasma deposited to produce PIMM film. The Vickers micro hardness number (VHN) was 110. The brake rotor with the film was uniaxially hot pressed at 20 ksi at 450° C. Subsequently, the rotor was heated in an electric oven for ten minutes at 700° C. The film reacted partially reaching an average VHN of 660. Finally, during the braking operation, the coatings were reshaped and fully reacted, forming the final coating with an average VHN of 850. The friction coefficients were near 0.7.

EXAMPLE IV

On a Ti alloy (Ti-6Al-4V alloy) brake rotor, a film layer comprising the metallic composition $Al_{50}Ni_{30}Fe_{10}Ti_{7}$—W with 5% friction enhancers (TiC) was mechanically alloyed during blending. It was then flame spray deposited to produce the PIMM film for the formation of an intermetallic compound called "advanced intermetallics or trialuminides." The flame deposited films were soft, malleable, and easy to mechanically form and polish. The film was composed of 20% intermetallic compound and 80% of PIMM, by volume. The VHN was 250. The brake rotor with the film was uniaxially cold pressed at 20 ksi. Subsequently, the rotor was heated in an electric oven for ten minutes at 700° C. The film reacted partially reaching an average VHN of 720. Finally, during the braking operation, the film was reshaped and fully reacted forming the final coating with an average VHN of 1240. The friction coefficient was about 0.64.

EXAMPLE V

Cd and S powders and/or Cadmium-sulfur rich powders were deposited on brake backing plates by fluidizing bed-coating methods. Iron based friction material was joined to the coated brake backing plate by mechanical pressing. After mechanical pressing, a reaction sintering method was employed to produce bonding composites FeS-Cds-FeCd, which are the basis for the joining of the backing plates and the frictional material. Standard brake pad production methods were used and common testing procedures were employed to conduct the testing of the brake pads. Superb temperature resistant brake pads were obtained. The pads had increased in shear strength up to a factor of six with respect to high quality pads.

EXAMPLE VI

The last powder technique to be described involves the layering of metallic sheets with films of precursor-materials-mix powders. The metallic sheets are bonded together by the layer of metallic material comprising intermetallic compounds. Rolling, or forging, accomplishes final consolidation. After consolidation of the layered structure, a thermal reaction of the powder is induced, heating the composite. The principal advantage of this system is the potential for large energy absorption due to the two-dimensional crack stopping ability of the macroscopic layering. There is also the potential for relatively isotropic properties. Finally, the composites are easily formed to final shape by the mechanical deformation process. An example of a composite produced by this method was done using a powder consisting of unreacted-mechanically alloyed particles of NiAl alloy between 3003 Al alloy sheets, which were subsequently pressed (15 ksi) to consolidate the layered structure (or by rolling). At a reaction below 650 Degrees C., the sheets of composite comprising Al and a metallic layer comprising an intermetallic compound presented an increase in bending strength near double that of an aluminum sheet of the same thickness. The overall composite density is similar to that of Al alone. The composite has a notched impact energy of 74 ft-lbs compared to 0.2 ft-lbs of NiAl. This composite displayed 8% elongation at room temperature.

Other embodiments and modifications of the present invention should be readily apparent to those of ordinary skill in the art having the benefit of the teachings of the foregoing description. For example, other hot-working processes than the one specifically described may be employed, such as forging, torsion, or any other hot-working process known in the art. The invention may be practiced using other metallic alloys for brake rotors/drums/discs as well, such as steel, or any reacting intermetallic compound. Therefore, it is to be understood that the present invention is not to be limited to the teachings presented and that such further embodiments and modifications are intended to be included within the spirit and broad scope of the appended claims.

What we claim is:

1. A method of making particulates comprising an intermetallic compound comprising the steps of:

(i) mixing at least two elemental metals to form a homogenous precursor suitable for forming an intermetallic compound;

(ii) mechanically alloying said precursor to form said particulates; and (iii) reactively sintering said particulates at a temperature sufficient to change said particulates to a semi-solid/liquid state such that said particulates react into an intermetallic compound.

2. The method recited in claim 1 wherein said elemental metals are powdered metals comprising aluminum and one or more metals selected from a group consisting of nickel, titanium, and iron.

3. The method recited in claim 1 wherein said precursor further comprises at least one enhancer selected from a group consisting of: strengthening enhancer, friction enhancer, and wear enhancer.

4. The method recited in claim 1 wherein said particulates are reactively sintered in a high temperature fluidizing bed.

5. Particulates made according to the method of claim 1.

6. A method of making a metallic coating comprising the steps of:

(i) forming an alloyed agglomerate from a precursor comprising at least two metals suitable for forming an intermetallic compound;

(ii) reacting said agglomerate to partially convert said agglomerate to an intermetallic compound;

(iii) depositing a coating of said partially converted agglomerate onto a roughened surface of a substrate;

(iv) conditioning said coating to conform with a geometry of said substrate; and (v) reactively sintering said coating.

7. The method recited in claim 6 wherein said agglomerate is formed by mechanically alloying said precursor.

8. The method recited in claim 6 wherein said agglomerate is partially converted to an intermetallic compound by thermal treatment.

9. The method recited in claim 6 wherein said partially converted agglomerate is deposited as a thin coating relative to a thickness of said substrate.

10. The method recited in claim 6 wherein said coating is reactively sintered at a temperature below or about a melting point of said deposited metal having a lowest melting point.

11. The method recited in claim 6 wherein said physically conditioned film is reactively sintered at a temperature sufficient to change said film to a semi-solid/liquid state.

12. The method recited in claim 6 wherein said solid substrate is a metallic, ceramic, or polymeric material.

13. The method recited in claim 6 wherein said elemental metals are powdered metals comprising aluminum and one or more metals selected from a group consisting of nickel, titanium, and iron.

14. The method recited in claim 6 wherein said agglomerate comprises aluminum and one or more metals selected from a group consisting of nickel, titanium, and iron.

15. The method recited in claim 6 wherein said intermetallic compound comprises aluminum and one or more metals selected from a group consisting of nickel, titanium, and iron.

16. The method recited in claim 6 wherein said coating comprises aluminum and one or more metals selected from a group consisting of nickel, titanium, and iron.

17. The method recited in claim 6 wherein said thermally treated agglomerate is annealed before it is deposited on said substrate.

18. The method recited in claim 6 wherein physically conditioning said soft, malleable, metallic film on said substrate comprises frictional contact, cold working, or peening.

19. The method recited in claim 6 wherein said agglomerate is applied to said substrate with at least one enhancer selected from a group consisting of: strengthening enhancer, friction enhancer, and wear enhancer.

20. A coating made according to the method of claim 6.

21. A substrate comprising the coating of claim 6.

22. A substrate according to claim 6 that is a part for a braking system for a vehicle or other machine.

23. The substrate of claim 6 that is a brake rotor, brake drum, or brake disc.

24. The substrate according to claim 6 that is a clutch part.

25. The substrate according to claim 6 that is an engine part or engine block.

26. The substrate according to claim 6 that is a screw for a polymer or plastic extruder.

27. The substrate according to claim 6 that is a barrel of a gun, riffle, cannon, or aircraft landing gear.

28. A method of making a metallic coating comprising the steps of:

(i) forming an alloyed agglomerate from a precursor comprising at least two metals suitable for forming an intermetallic compound;

(ii) depositing a coating of said partially converted agglomerate onto a roughened surface of a substrate;

(iii) conditioning said coating to conform with a geometry of said substrate; and (iv) reactively sintering said coating.

29. The method recited in claim 28 wherein said agglomerate is formed by mechanically alloying said precursor.

30. The method recited in claim 28 wherein said partially converted agglomerate is deposited as a thin coating relative to a thickness of said substrate.

31. The method recited in claim 28 wherein said coating is reactively sintered at a temperature below or about a melting point of said deposited metal having a lowest melting point.

32. The substrate of claim 28 that is a brake rotor, brake drum, or brake disc.

33. A method of making a metallic coating comprising the steps of:

(i) forming an alloyed agglomerate from a precursor comprising at least two metals suitable for forming an intermetallic compound;

(ii) depositing a coating of said partially converted agglomerate onto a roughened surface of a substrate; and (iii) reactively sintering said coating.

34. The method recited in claim 33 wherein said agglomerate is formed by mechanically alloying said precursor.

35. The method recited in claim 33 wherein said partially converted agglomerate is deposited as a thin coating relative to a thickness of said substrate.

36. The method recited in claim 33 wherein said coating is reactively sintered at a temperature below or about a melting point of said deposited metal having a lowest melting point.

37. The substrate of claim 33 that is a brake rotor, brake drum, or brake disc.

38. A method of making a metallic coating comprising the steps of:

(i) forming an alloyed agglomerate from a precursor comprising at least two metals suitable for forming an intermetallic compound;

(ii) reacting said agglomerate to partially convert said agglomerate to an intermetallic compound; and (iii) depositing a coating of said partially converted agglomerate onto a roughened surface of a substrate.

39. The method recited in claim 38 wherein said agglomerate is formed by mechanically alloying said precursor.

40. The method recited in claim 38 wherein said agglomerate is partially converted to an intermetallic compound by thermal treatment.

41. The method recited in claim 38 wherein said partially converted agglomerate is deposited as a thin coating relative to a thickness of said substrate.

42. The substrate of claim 38 that is a brake rotor, brake drum, or brake disc.

43. A method of creating a bond with an intermetallic compound between a plurality substrates comprising:

(i) depositing a combination of elemental metals onto a first substrate to form a soft, malleable, metallic film thereon, said combination of metals being suitable for forming an intermetallic compound;

(ii) mechanically joining a second substrate to said first substrate with said film;

(iii) reactively sintering said film by applying a temperature and pressure for a time period sufficient to react said film; and (iv) reactively sintering said film at a temperature sufficient to complete said reaction of said metals and form said intermetallic compound.

44. The method recited in claim 43 wherein said combination of elemental metals is formed by mechanically alloying powders of said elemental metals.

45. The method recited in claim 43 wherein said combination of elemental metals is deposited as a thin coating relative to a thickness of said substrate.

46. The method recited in claim 43 further comprising rolling the substrates to consolidate said bond.

47. The method recited in claim 43 further comprising forging the substrates to consolidate said bond.

48. The substrates of claim 43 that comprise a brake rotor, brake drum, or brake disc.

* * * * *